US006528161B1

(12) United States Patent
Sameli

(10) Patent No.: US 6,528,161 B1
(45) Date of Patent: Mar. 4, 2003

(54) METHOD FOR THE PRODUCTION OF HYDROLYSIS STABILIZED POLYESTER MONOFILAMENTS AND USE THEREOF

(75) Inventor: Werner Sameli, Emmenbruecke (CH)

(73) Assignee: Rhodia Industrial Yarns AG, Emmenbruecke (CH)

( * ) Notice: Subject to any disclaimer, the term of this patent is extended or adjusted under 35 U.S.C. 154(b) by 0 days.

(21) Appl. No.: 10/088,617

(22) PCT Filed: Nov. 14, 2000

(86) PCT No.: PCT/CH00/00606

§ 371 (c)(1),
(2), (4) Date: Mar. 19, 2002

(87) PCT Pub. No.: WO01/40554

PCT Pub. Date: Jun. 7, 2001

(30) Foreign Application Priority Data

Dec. 3, 1999 (CH) ..... 2228/99

(51) Int. Cl.[7] ..... D02G 3/00
(52) U.S. Cl. ..... 428/364
(58) Field of Search ..... 264/172.17; 8/188; 428/364, 395; 528/106, 107

(56) References Cited

U.S. PATENT DOCUMENTS 3,657,191 A 4/1972 Titzmann
4,171,422 A 10/1979 Chakravarti ..... 528/437
4,321,304 A * 3/1982 Castellucci ..... 428/418

FOREIGN PATENT DOCUMENTS

DE 19 29 149 A 12/1970
DE 195 26 405 A 1/1997

OTHER PUBLICATIONS

Database Chemabs "Online! Chemical Abstracts Service, Columbus, Ohio, US; Shima, Takeo et al: Polyester with Low . . . " Retrieved From STN, Database Accession No. 81:153481 XP002134472 Abstract & JP 48 041713 B, Dec. 7, 1973.

* cited by examiner

*Primary Examiner*—N. Edwards
(74) *Attorney, Agent, or Firm*—Michael J. Striker

(57) ABSTRACT

The invention relates to a method for the production of hydrolysis stabilized polyester monofilamennts having a diameter of 0.12–0.80 mm viscosity index (VI) of at least 90 ml/g, wherein a liquid additive mixture consisting of ethylene carbonate and an alkylphosphonium salt as a catalyst is continuously added in a metered manner immediately in front of the extruder. The monofilament produced according to the inventive method is characterized by a residual tear strength of more than 55% after a 6-day period of treatment in water at a temperature of 125° C. and by a viscosity index of at least 75 ml/g.

4 Claims, 1 Drawing Sheet

Figure 1:
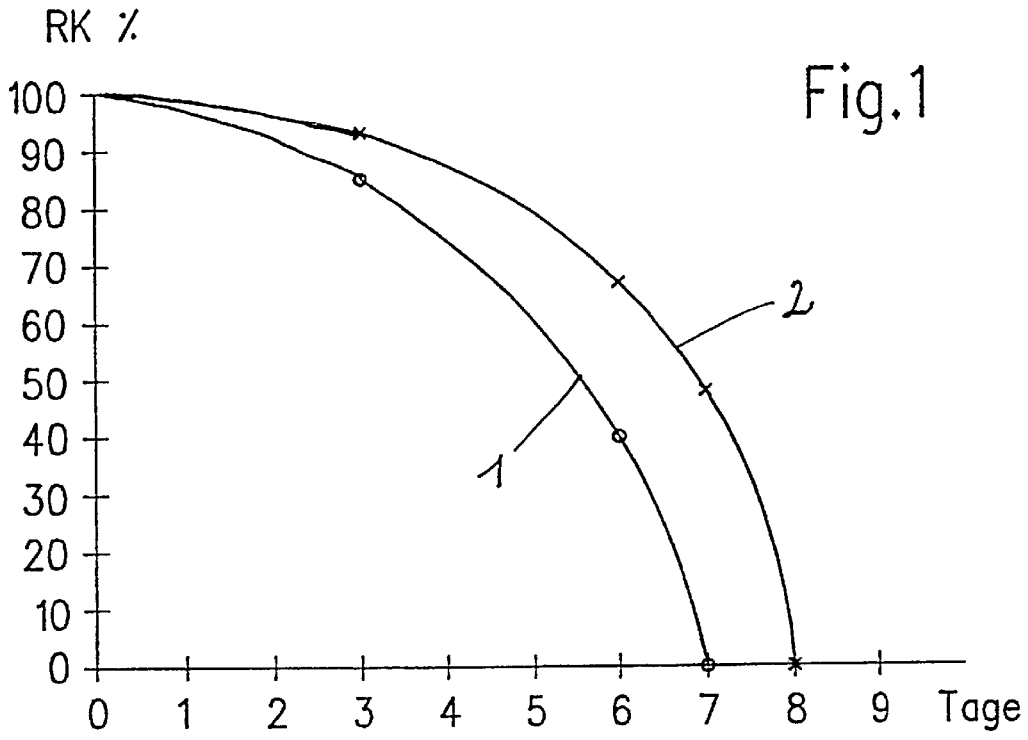

METHOD FOR THE PRODUCTION OF HYDROLYSIS STABILIZED POLYESTER MONOFILAMENTS AND USE THEREOF

The invention relates to a method for producing hydrolysis-stabilized monofilaments from a post-condensed polyester granule with a viscosity index (VI) of at least 90 mL/g and to their use in fabrics for the food, pharmaceutical and paper industries.

For economic reasons, polyester fabrics are used predominantly in the production of transporting belts and for filtration in the food industry. Modern production plants in the food industry are run at higher speeds and elevated temperatures. Because of the frequently higher temperatures and the, high humidity, the conditions, under which the transporting belts or filter fabrics are used, require that the materials have a good resistance to hydrolysis. It is well known that pure, post-condensed polyethylene terephthalate is not resistant to hydrolysis in a hot moist medium and therefore satisfies the requirements of the food industry only partially. In addition, polyester monofilaments may not contain any toxic additives.

Polyesters (PET) are thermoplastic materials, which contain at least 95 percent by weight of polyethylene terephthalate, polybutylene terephthalate and polynaphthalate units.

Increasing the hydrolysis resistance of polyethylene terephthalate by adding carboduimides has long been known. These additives also lead to a satisfactory hydrolysis resistance of the polyester. However, they are toxic, lead to skin irritation was and to a worsening of the degree of whiteness.

The DE-A-19 526 405 discloses a method for reducing the number of carboxyl end groups of polyesters. For the known method, alkylene carbonate, with alkyl triphenyl phosphonium bromide as catalyst, is employed preferably in the feed pipeline to the post-condensation reactor. The viscosity should be reduced as little as possible in the resulting post-condensed polyester. The known method is used for the heat and color stabilization of a polyester. The known post-condensed polyester granulate is said to be suitable for the production of high-strength yams for tire cord; these yams usually consist of multiple filaments. Such yams must be thermally stable during vulcanization and the color should change as little as possible; however, they are hardly exposed to moist heat. Only the post-condensed polyester granulate is intended as a starting material for producing high-strength yams. However, information concerning the production of the yams and their tensile strength is not provided. The manufacture of monofilaments is not disclosed.

The known method has the disadvantage that the post-condensed polyester granulate must be melted once again for producing yams. In the presence of the polycarbonate with catalyst, thermal decomposition takes place with formation of gas bubbles, which can lead to a disorder in the polyester structure in a yam, especially in a monofilament yam and, with that, to inhomogeneities. Furthermore, halides are used as catalysts. They have the disadvantage that even small amounts produce a discoloration and form poisonous acids (HCl and HBr) when combusted.

U.S. Pat. No. 3,657,191 discloses a method for decreasing the number of carboxyl end groups of polyester in the preparation also of monofilaments and mentions the possibility of using ethylene carbonate but does not describe any examples. All the examples were carried out with monofunctional glycidyl ether. The known method does not permit a comparison with the results obtained. The long reaction times for blocking the carboxyl end groups are a disadvantage of the known method.

It is an object of the invention to prepare hydrolysis-resistant, atoxic, homogeneous monofilaments, which have no inclusions or undrafted parts, from polyesters for use in the food, pharmaceutical and paper industries.

It is a further object of the invention to produce a monofilament from polyester, the hydrolysis resistance of which is better than that of monofilaments of the state of the art.

Yet another object is the use of the hydrolysis-stabilized polyester monofilament for producing fabrics for transporting belts and filter fabrics for the food, pharmaceutical and paper industries.

Pursuant to the invention, the object is accomplished owing to the fact that a liquid mixture of additives of ethylene carbonate and an alkyl phosphonium salt is added continuously to the polyester granulate having a viscosity index (VI) of at least 90 mL/g directly before it enters the extruder. The continuous addition to the granulate ensures good homogenization and a surprisingly short reaction time.

As ethylene carbonate (EC) (1,3-dioxalan-2-one), the conventional commercial product with a melting point of about 39° C. is used. It is prepared from ethylene oxide and liquid carbon dioxide. According to information from the "Registry of Toxic Effects of Chemical Substances" of the US Department of Health, Educating and Welfare, ethylene carbonate is regarded as harmless. Moreover, only carbon dioxide gas is released during the reaction in the polyester. The remaining glycol residue reacts with terminal polyester groups.

As catalysts, alkyl or aryl phosphonium salts, such as tetrabutyl phosphonium acetate (TBPA), are suitable. They act as catalysts for blocking the carboxyl end groups of the polyester.

It is appropriate that liquid additives of 1.5% to 0.5% by weight of ethylene carbonate and 0.005% by weight to 0.025 by weight, especially of 0.010% by weight to 0.002% by weight and particularly of 0.11% by weight to 0.15% by weight of an alkyl phosphonium salt, based on the polyester granulate, be used. With less than 0.005% by weight of the catalyst, the residual tensile strength is too low; with more than 0.025% by weight, the residual tensile strength is also too low and the monofilament cannot be used for technical purposes.

The polyester monofilament, after being treated in water at 125° C. for 6 days, has a residual tensile strength of more than 55% and a viscosity index of less than 75 mL/g. This indicates a significant improvement in the hydrolysis resistance of monofilaments over that of monofilaments of the state of the art.

Measurement Methods:

Viscosity Index According To ISO Standard 1628

Tensile strength. measured as the highest tensile strength in N according to DIN 53 834, Part 1, page 177.

Residual Tensile Strength: The tensile strength of the treated yam as a percentage of the tensile strength of the untreated yarn.

Hydrolysis Resistance:

The monofilaments were treated for 3 to 8 days in an autoclave in water at 125° C. After the hydrolysis, the temperature was lowered to below 100° C., the yarns were removed and the residual tensile strength was determined.

Hydrolysis-resistant monofilaments of polyester are particularly suitable for the manufacture of fabrics, which are to be used in the food, pharmaceutical and paper industry.

Hydrolysis-resistant polyester is used not only for the manufacture of monofilaments, but also generally for industrial yams.

The invention is to be described in greater detail by means of some examples.

EXAMPLE 1 (COMPARISON EXAMPLE)

A post-condensed polyethylene terephthalate in granulate form, with a granulate viscosity VI of 98 mL/g, is used as starting polymer for all examples. This granulate is melted in an extruder and extruded through spinnerets into monofilaments with a diameter of 0.50 mm. The monofilaments were cooled in the conventional manner in water, stretched, relaxed, provided with a preparation agent and wound up.

EXAMPLE 2

Ethylene carbonate puriss. (EC, 0.23% by weight) is mixed with 0.011% by weight of tetra-n-butylphosphonium acetate (TBPA), based on polyethylene terephthalate (PET), melted and added in liquid form at 50° C. to the PET granulate before it enters the extruder. Further processing is as described in Example 1.

EXAMPLE 3

Ethylene carbonate puriss. (EC, 0.25% by weight) is mixed with 0.015% by weight of tetra-n-butylphosphonium acetate (TBPA), based on polyethylene terephthalate (PET), melted and added in liquid form at 50° C. to the PET granulate before it enters the extruder. Further processing is as described in Example 1.

Figure 2:
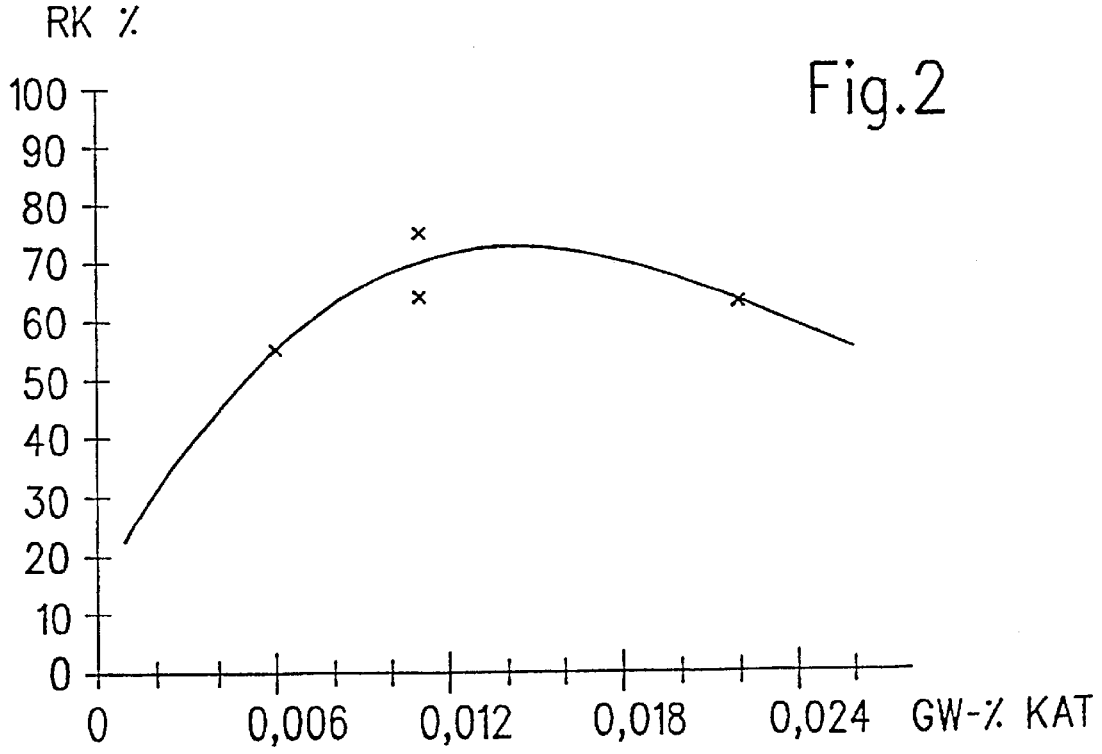

The results of the determination of the hydrolysis resistance are shown graphically in the diagrams, in which FIG. 1 shows the change in the residual tensile strength (RK%) with and without the inventive additive and FIG. 2 shows the residual tensile strength as a function of the amount of catalyst after 6 days of treatment in water at 125° C. and 1.5 bar.

Curve 1 of FIG. 1 shows the residual tensile strength (%) of a known polyester monofilament without additive as a function of time; curve 2 shows a similar diagram for the inventive monofilament.

In FIG. 2, the residual tensile strength as a function of the amount of catalyst after a treatment in water at 125° C. and 1.5 bar for six days. The hydrolysis resistance, expressed in percent residual tensile strength as a function of the catalyst concentration, passes through a maximum at about 0.14 g/kg and thus corresponds to the optimum amount.

Stability Test of the Additive Mixture

Ethylene carbonate (2.5 g) and 0.214 g of tetrabutyl phosphonium phosphate in 70% methanol as catalyst were melted in the waterbath at about 50° C., homogenized and added in 0.2 g amounts to screw-top test tubes. The latter were exposed for different times to 120° C. in the drying oven, subsequently cooled and dissolved in 10 mL or methanol. GC analysis revealed that a reaction had not taken place, that is, that ethylene carbonate was not changed by heat.

Ethylene carbonate for esterifying the —COOH groups surprisingly resulted in low —COOH values and good color in the monofil.

Surprisingly, after the treatment in water at 125° C. for 6 days, the tensile strength of the inventive polyester monofilaments was significantly better than that of known monofilaments, which had not been stabilized to resist hydrolysis.

What is claimed is:

1. A method for the preparation of hydrolysis-stabilized monofilaments from a post-condensed polyester granulate with a viscosity index (VI) of at least 90 mL/g and with a diameter of 0.12–0.80 mm by melt spinning, wherein a liquid mixture of the additives, ethylene carbonate and an alkyl phosphonium salt as catalyst, is added continuously to the post-condensed polyester granulate before it enters the extruder.

2. The method of claim 1, wherein the liquid additive of 0.15% by weight to 0.5% by weight of ethylene carbonate and 0.005% by weight (50 ppm) to 0.025% by weight (250 ppm) of an alkyl phosphonium salt, based on the polyester granulate, is used.

3. The method of claim 2, wherein tetra-n-butyl phosphonium acetate (TBPA) is used as alkyl phosphonium salt.

4. A monofilament, prepared by the method of claim 1, wherein the residual tensile strength after a treatment of 6 days in water at a temperature of 125° C. is more than 55% and the viscosity is at least 75 mL/g.

* * * * *